United States Patent [19]

Darowski

[11] Patent Number: 4,615,059

[45] Date of Patent: Oct. 7, 1986

[54] CRIB OR CRADLE FOR CHILDREN

[76] Inventor: Waldemar S. Darowski, 4613 Boulevard Pl., Des Moines, Iowa 50311

[21] Appl. No.: 706,822

[22] Filed: Feb. 28, 1985

[51] Int. Cl.[4] ..... A61G 7/10

[52] U.S. Cl. ..... 5/108; 5/127; 297/273

[58] Field of Search ..... 5/101–109, 5/124, 127, 129, 62; 128/33; 297/273, 276, 281, 282

[56] References Cited

U.S. PATENT DOCUMENTS

| | | | |
|---|---|---|---|
| 132,745 | 11/1872 | Batley . | |
| 138,320 | 4/1873 | Doremus | 5/127 X |
| 177,649 | 5/1876 | McLean | 5/108 X |
| 1,132,432 | 3/1915 | Brzozowski | 5/108 |
| 1,218,837 | 3/1917 | Christopher . | |
| 1,401,286 | 12/1921 | Sisbower et al. | 5/129 |
| 1,566,044 | 12/1925 | Sisbower et al. | 5/124 X |
| 1,845,142 | 2/1932 | Friesuer | 297/282 X |
| 2,283,000 | 5/1942 | Feldman | 297/273 |
| 3,125,767 | 3/1964 | Griggs et al. | 5/109 |
| 3,737,924 | 6/1973 | Davis . | |
| 4,080,673 | 3/1978 | Weisler . | |

*Primary Examiner*—William F. Pate, III
*Assistant Examiner*—Richard E. Chilcot, Jr.
*Attorney, Agent, or Firm*—Henderson & Sturm

[57] ABSTRACT

This invention comprises a crib or cradle for infants and children wherein a crib or cradle structure (12) is rockably supported on a relatively stationary support structure (11) by an articulated assembly (13). The articulated assembly (13) is extremely quiet, very easily maintained, and includes no mechanical connections, being comprised of a plurality of vertically spaced dowels (21), (37), (41), disposed one above the other and interconnected by endless belts or straps (36), (39) permitting relative swinging movement among and between the dowels (21), (37), (41).

4 Claims, 6 Drawing Figures

CRIB OR CRADLE FOR CHILDREN

TECHNICAL FIELD

The present invention relates generally to a children's bed, and more particularly to a child's crib or cradle.

BACKGROUND ART

Mankind has known of cribs and cradles for infants and children for many centuries. Initially they undoubtedly were hammock-like members swingably supported. For centuries they were not more than a frame connected to a pair of end pieces having rounded bottom surfaces such that the frame would rock upon being moved sideways.

In more modern times, the frame was rockably mounted upon a relative stationary support, slatted sides being provided whereby the child could stand up in the bed, thus advancing the age of children who could use the combination of a cradle and bed. Age old problems remained, however, such as: structural stability and serviceability, gentleness of rocking and the quietness of rocking of the children's bed.

DISCLOSURE OF THE INVENTION

The above problems are substantially resolved, without undue compromise of other desirable attributes that are already provided by prior art devices, by the provision of the invention disclosed herein.

The present invention relates generally to baby or children's beds, and more particular to such beds that provide a rocking motion for the bed proper as compared to the supporting frame.

In particular the baby bed comprises a crib rockably mounted by an articulated unit on a semi-stationary frame. The crib includes a four-sided box-like, slatted enclosure to which an I-shaped end piece is secured at each lower end, the end pieces being appropriately interconnected for structural stability. The frame comprises a pair of upright Roman numeral II shaped standards adapted to rest upon the floor—but movable, which standards are also interconnected, and including further a pair of elongated rods extended lengthwise of the bed on each side thereof, each rod being inserted at each end in a socket provided therefore in the upper outer end of each standard.

To rockably support the crib upon the support frame, an endless strap is placed about the end of each rod adjacent its socket, and in transverse alignment with an adjacent end piece. A short dowel is inserted through the lower loop of each strap, with ends protruding on either side of the lower loop, and two additional second or lower straps are placed at their upper loops about each protruding dowel end. At each lower loop of each second strap, another dowel is placed, those lower dowels being connected to the outer lower ends of each I-shaped end piece.

Thus, upon movement of the crib, that movement is transmitted by the lower dowels upwardly through the lower straps to the upper dowels, and then such sideways movement is again transmitted and translated through the upper loops to the stationary rods. It is readily seen that the improved crib structure eliminates mechanical pivot elements and their attendant wear, repair and noise deficiencies. By the provisions of unique dowel and cloth or the like straps, such deficiencies are remedied. Furthermore, the novel articulation arrangement provides for a smoother and more horizontal movement of the bed proper, a gentler rocking if you will.

Lastly, but as importantly, with the rocking structure disposed below the bed proper and inwardly of all sides of the bed proper and the stationary standards at each end of the supporting frame, all of the advantages of a rocking bed are obtained with increased and improved safety for the child occupants.

BRIEF DESCRIPTION OF THE DRAWING

These and other attributes of the invention will become more clear upon a thorough study and review of the following detailed description of the best mode for carrying out the invention, particularly when reviewed in conjunction with the drawings, wherein.

BEST MODE FOR CARRYING OUT THE INVENTION

Figures 1, 2, 3:
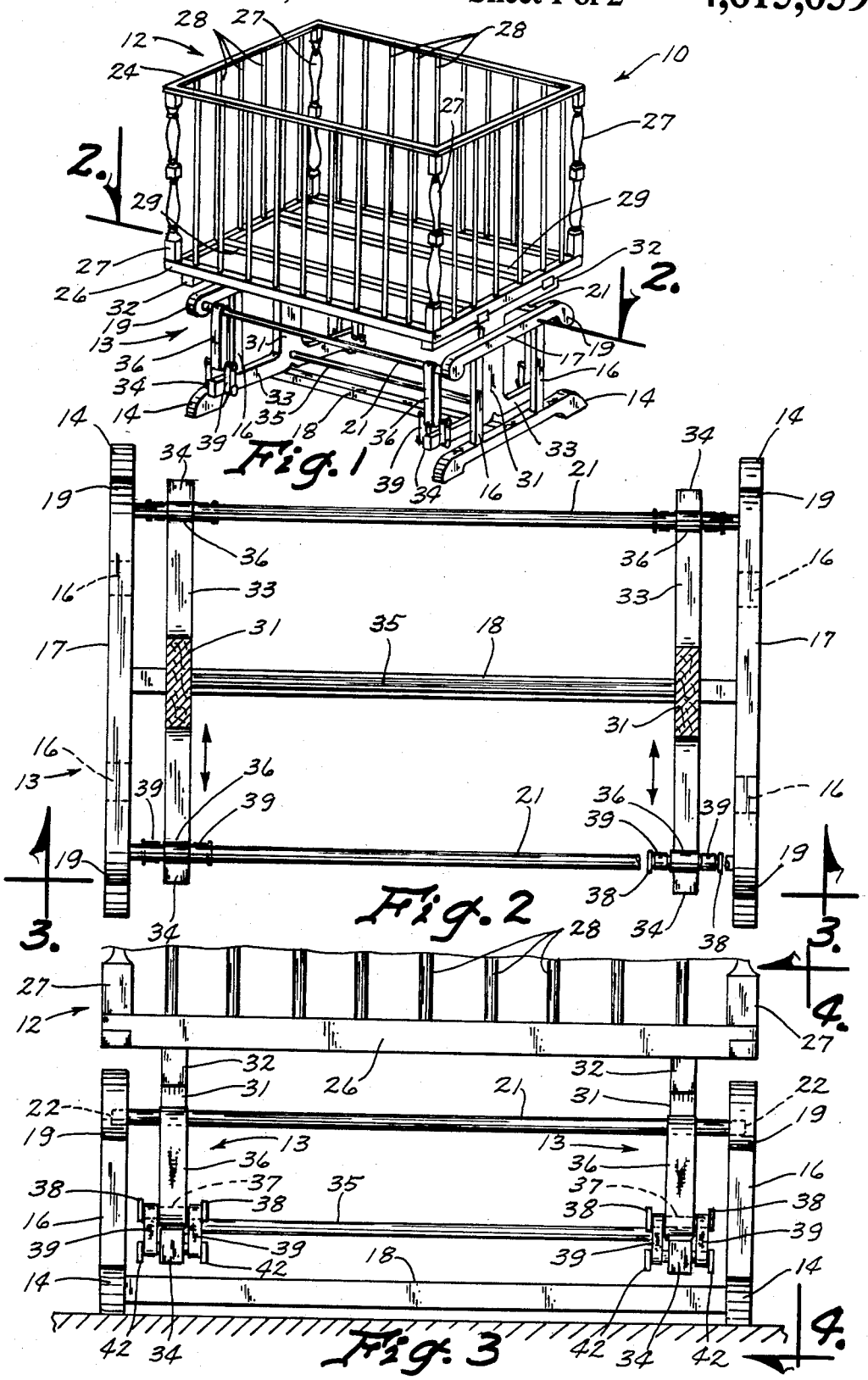
FIG. 1 is a perspective view of my invention, showing the baby bed without any mattress or the like which forms no part of the invention.
FIG. 2 is an enlarged horizontal cross sectional view taken along the line 2—2 in FIG. 1.
FIG. 3 is a partial side elevational view taken along the line 3—3 in FIG. 2.

Referring now to the drawings, and in particular to FIG. 1, the children's bed of this invention may be seen as depicted generally by the numeral (10). More particularly, the children's bed (10) comprises a support assembly (11) adapted to be removably placed on a floor surface, a bed assembly (12) for supporting and holding a child, and an articulated assembly (13) connected to both the bed assembly (12) and the support assembly (11) whereby the bed assembly (12) is movably or rockably mounted on the support assembly (11). It is to be noted that the articulated assembly (13) is disposed entirely below the lateral confines of the bed assembly (12) as is more clearly seen hereinafter.

Figure 4:
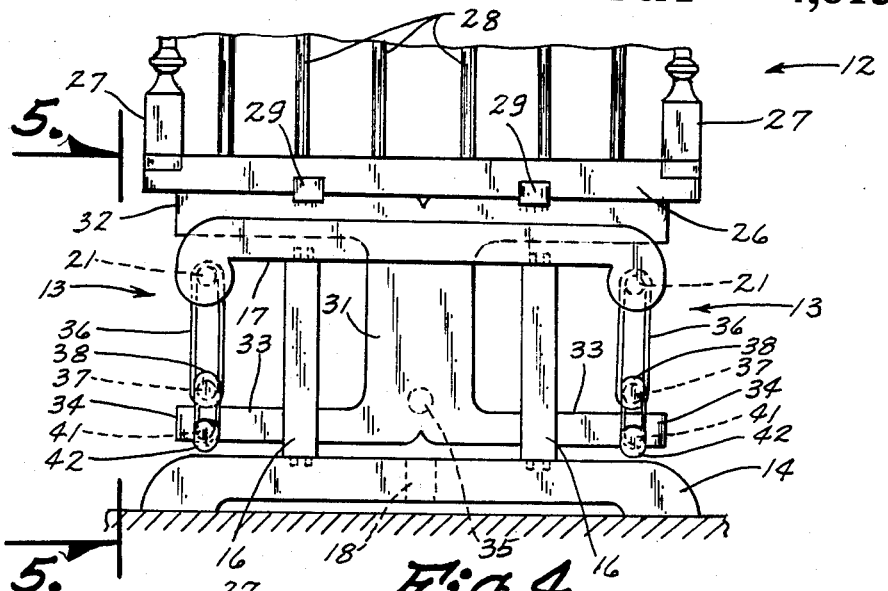
FIG. 4 is a partial end elevational view taken along the line 4—4 in FIG. 3.

The support assembly (11) comprises specifically a pair of upright standards (14), each at an end of the support assembly (11), with each standard (14) having a pair of upright members (16) connected at their upper ends to a transversely disposed cross piece (17) (FIG. 4). The standards (14) are interconnected by a longitudinally extended brace (18) for structural rigidity. Referring to FIGS. 1-3 inclusive, it is seen that a pair of elongated rods (21) are provided, each on one side of the support assembly (11), with the outer end of each rod (21) inserted into a socket (22) (FIG. 5) formed in each outer end (19) of a cross piece (17).

The bed assembly (12) includes an upper rectangular frame (24) and a lower rectangular frame (26) of the same general dimensions, the frames (24) and (26) interconnected by vertically disposed corner posts (27) and a plurality of horizontally spaced slats (28) as clearly seen in FIG. 1. The lower frame (26) includes a plurality of longitudinally extended support members (29) for aiding in supporting a mattress or the like.

The bed assembly (12) includes further at each end thereof an I-shaped end piece (31) disposed inwardly of the standards (14) of the support assembly (11) (See FIG. 5), with each end piece (31) including a horizontally disposed upper portion (32) which is connected to the base of the lower bed frame (24). The lower portion (33) of each end piece (31) has outer ends (34) (FIG. 6), each of which is disposed below in generally vertically disposed relation to an outer rounded end (19) of a standard cross piece (17). The end pieces (31) are interconnected for structural rigidity by an elongated connecting member (35) (FIG. 2).

To rockably support the bed assembly (12) on the support assembly (11), an articulated assembly (13) is disposed at each corner of the support assembly (11). Each articulated assembly is identical and comprises an upper endless strap (36) (FIGS. 4–6) the upper end of which is trained about an outer end of a rod (21), such that an endless strap (36) is found at each corner of the support assembly (11) depending from the rods (21). At the lower end of each endless strap (36), an upper dowel (37) is nested, the dowels (37) each having enlarged ends (38) so as to retain thereon a second pair of endless straps (39) disposed outwardly on each side of the upper, first strap (36).

Figure 5:
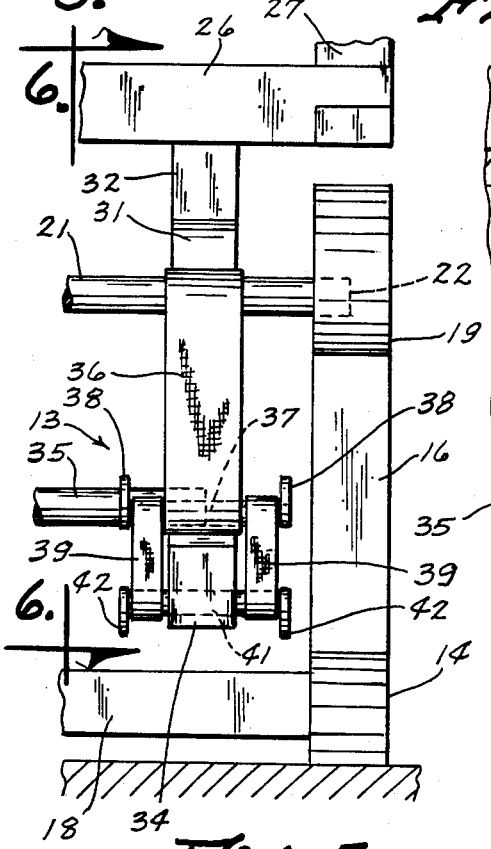
FIG. 5 is a further enlarged fragmentary side elevational view of one lower end of the bed, taken along the line 5—5 in FIG. 4.
Figure 6:
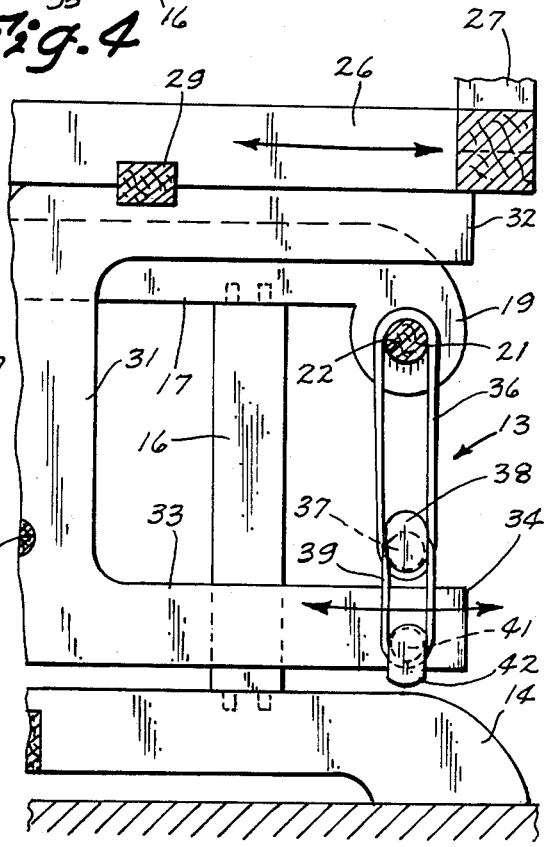
FIG. 6 an elevational view taken along the line 6—6 looking outwardly from inside the FIG. 5 structure.

The lower ends of the lower, second straps (39) are trained about a lower, second dowel (41), also having enlarged ends (42), the shank (43) of the dowel (41) being inserted through a bore formed therefore in the outer end (34) of the end piece lower portion (33) (FIGS. 5 and 6).

By this arrangement, upon movement of the bed assembly (12) by action of a child therein, or by the bed assembly (12) being pushed or otherwise moved by another person from outside the bed (10), the movement is transmitted upwardly through the lower dowels (41), then the lower pairs of straps (39), then the upper dowels (37), and then via the upper straps (36) to the stationary rods (21). It may readily be appreciated that this rocking movement is very gentle, and tends to maintain the bed assembly (12) in more of a horizontal type of rocking movement as compared to the normal pivotal or arcuate movement, this horizontal-type movement due to the articulated nature of the assemblies (13) at each corner of the bed (10).

Furthermore, it is readily appreciated that the means of movably connecting the support assembly (11) with the bed assembly (12) has eliminated all forms of mechanical nut-and-bolt connecting elements and their attendant wear and noise problems. The straps (36) and (39) may be of cloth, leather, nylon or the like, along with the dowels (37) and (41), including the rods (21) being of wood or the like such that a very silent action is maintained during rocking of the bed assembly (12) relative to the support assembly (11). And as was pointed out hereinbefore, for safety and esthetic purposes, the entire moving mechanism of the bed (10) is placed below the bed assembly (12) and within the lateral confines of its frames (24) and (26).

Obviously, many modifications and variations of the present invention are possible in light of the above teachings. It is therefore to be understood, that within the scope of the appended claims, the invention may be practiced otherwise than as specifically described therein.

I claim:

1. A children's bed comprising:

(a) bed means for supporting a child:

(b) support means placeable between said bed means and a floor surface, and including a pair of transversely spaced, elongated rods extended longitudinally of and below said bed means; and (c) means connected to both said bed means and said support means and movably mounting said bed means, and wherein said mounting means includes an endless first strap trained about each outer end of each elongated rod adjacent a corner of said support means, and a unit movably connected between each said first strap and said bed means.

2. The children's bed of claim 1 wherein said bed means comprises an upright end piece secured to and disposed below each end of said bed means, each end piece disposed inwardly of each standard and having a transversely extended lower portion having outer ends, said support means elongated rods extended directly above said outer ends.

3. The children's bed of claim 2 wherein wherein each said relatively movable means comprises a dowel held by the lower loop end of each first strap, and a pair of endless second straps each trained at an upper end about an exposed end of each of said first dowels with the lower ends thereof connected to said cross piece whereby each trio of said first and second straps and first dowels comprises an articulated unit connecting said bed means to said support means.

4. The children's bed of claim 3 wherein a second dowel is secured to each outer end of each cross piece directly below a first dowel, and has trained about each exposed end thereof a lower end of each second strap the upper end of which is trained about the upper dowels thereabove.

* * * * *